US009770751B2

(12) United States Patent
Endo et al.

(10) Patent No.: US 9,770,751 B2
(45) Date of Patent: Sep. 26, 2017

(54) PUNCH DIE

(71) Applicant: AMADA HOLDINGS CO., LTD., Kanagawa (JP)

(72) Inventors: Shigeru Endo, Kanagawa (JP); Hiroshi Nakai, Kanagawa (JP)

(73) Assignee: AMADA HOLDINGS CO., LTD., Kanagawa (JP)

( * ) Notice: Subject to any disclaimer, the term of this patent is extended or adjusted under 35 U.S.C. 154(b) by 133 days.

(21) Appl. No.: 14/764,338

(22) PCT Filed: Feb. 19, 2014

(86) PCT No.: PCT/JP2014/053841

§ 371 (c)(1),
(2) Date: Jul. 29, 2015

(87) PCT Pub. No.: WO2014/132849

PCT Pub. Date: Sep. 4, 2014

(65) Prior Publication Data

US 2015/0367400 A1 Dec. 24, 2015

(30) Foreign Application Priority Data

Feb. 28, 2013 (JP) ..... 2013-038410

(51) Int. Cl.
*B21D 28/34* (2006.01)

(52) U.S. Cl.
CPC ..... *B21D 28/346* (2013.01); *B21D 28/34* (2013.01); *Y10T 83/9476* (2015.04)

(58) Field of Classification Search
CPC ..... Y10T 83/9476; Y10T 83/9457; Y10T 83/9461; Y10T 83/9423; Y10T 83/943;
(Continued)

(56) References Cited

U.S. PATENT DOCUMENTS 7,007,582 B2 3/2006 Iwamoto et al.
2004/0011178 A1 1/2004 Iwamoto et al.
(Continued)

FOREIGN PATENT DOCUMENTS

CN 202129343 2/2012
JP 2002-282962 10/2002
(Continued)

OTHER PUBLICATIONS

U.S. Appl. No. 14/764,334 to Shigeru Endo et al., filed Jul. 29, 2015.
(Continued)

*Primary Examiner* — Phong Nguyen
(74) *Attorney, Agent, or Firm* — Greenblum & Bernstein, P.L.C.

(57) ABSTRACT

A punch die includes: a punch body including a punch edge portion at a lower end portion along an axis, a key projecting from an outer periphery, and a punch driver at an upper portion along the axis; a punch guide including an inner hollow elongated along the axis and receiving the punch body to be movable along the axis, and a keyway formed on an internal periphery of the inner hollow to extend along the axis and mesh with the key; a retainer collar rotatably combined with the punch guide at an upper end along the axis and around the axis, the punch driver passing through the retainer collar to be movable along the axis; and a punch head screwed in an upper end portion along the axis of the punch driver to regulate a position of the punch driver.

4 Claims, 3 Drawing Sheets

(58) Field of Classification Search
CPC ..... B21D 28/346; B21D 28/34; B21D 37/04; B21D 45/006
See application file for complete search history.

(56) References Cited

U.S. PATENT DOCUMENTS

| | | | | |
|---|---|---|---|---|
| 2006/0060046 | A1* | 3/2006 | Sugizaki | B21D 28/26 83/138 |
| 2006/0081107 | A1 | 4/2006 | Iwamoto et al. | |
| 2007/0034069 | A1* | 2/2007 | Endo | B21D 45/006 83/684 |
| 2013/0340588 | A1* | 12/2013 | Qi | B21D 28/34 83/698.31 |

FOREIGN PATENT DOCUMENTS

| | | |
|---|---|---|
| JP | 2007-105761 | 4/2007 |
| JP | 2009-233752 | 10/2009 |
| JP | 2010-23097 | 2/2010 |

OTHER PUBLICATIONS

International Search Report dated May 20, 2014.
Office Action issued in Taiwan Counterpart Patent Appl. No. 103105205, dated Jun. 27, 2016.

* cited by examiner

PUNCH DIE

TECHNICAL FIELD

The present invention relates to a punch die, which is attached to a punch holder of a punch press and then used, and in particular relates to a punch die which enables height regulation after sharpening an edge portion of a punch for example, in a state where a punch body fits in a punch body.

BACKGROUND ART

In a punch die which is attached to a punch holder of a punch press such as a turret punch press for example, when an punch edge portion of a punch body of the punch die wears out, it is normal to sharpen the punch edge portion. When the punch edge portion is thus sharpened, as the length size from a punch head to the punch edge portion of the punch die is shortened, a screwing relation between the punch head and the punch body is regulated to regulate the height. (See the PTL 1 for example)

CITATION LIST

Patent Literature

[PTL 1]: Japanese Patent Application Laid-open No. 2010-23097

SUMMARY OF INVENTION

The punch die as described in the PTL 1 is comprised of a cylindrical punch guide, in which a punch body having a punch edge portion at its lower end portion fits in such a way as to be movable upward and downward. On an internal periphery of the punch guide provided is a keyway in the vertical direction in which a key formed on the punch body slidably fits. And, on a upper face of the punch guide provided is a retainer collar in such a way as to be rotatable and fixable. Through the retainer collar, a punch driver that the punch body has is made to pass in such a way as to be movable upward and downward, and, between a punch head screwed in an upper end of the punch driver in such a way that its position is regulatable and the retainer collar, a stripper spring is repulsively loaded.

And, a sleeve that the punch head unitarily comprises passes through the retainer collar in such a way as to be movable only in the vertical direction. Therefore, as the retainer collar is rotated relative to the punch body, the screwing relation between the punch driver and the punch head is made to be regulated. In the punch guide, a cylindrical portion that the retainer collar comprises at its lower portion relatively rotatably fits.

In order to keep them to be relatively rotatable in a state where the cylindrical portion of the retainer collar fits in the punch guide, and in order to keep the fitting state of the retainer collar relative to the punch guide, a peripheral slot is formed on an upper side of the internal periphery of the punch guide. And, a projection portion that an outer periphery of the cylindrical portion of the retainer collar has fits in this peripheral slot. To engage or detach the projection portion with or from the peripheral slot, a communication slot is particularly formed to communicate the upper face of the punch guide with the peripheral slot.

Therefore, in the construction described in the PTL 1, it is necessary to independently machine the keyway for the key, which the punch body has, and the communication slot for the projection portion. There must be problems in that the number of machining steps is increased and the machining itself is made to be complex.

The present invention has been achieved in light of the aforementioned problem.

According to an aspect of the present invention, a punch die is comprised of: a punch body comprising a punch edge portion at a lower end portion along an axis, a key projecting from an outer periphery, and a punch driver at an upper portion along the axis; a punch guide comprising an inner hollow elongated along the axis and receiving the punch body to be movable along the axis, and a keyway formed on an internal periphery of the inner hollow to extend along the axis and mesh with the key; a retainer collar rotatably combined with the punch guide at an upper end along the axis and around the axis, the punch driver passing through the retainer collar to be movable along the axis; a punch head screwed in an upper end portion along the axis of the punch driver to regulate a position of the punch driver; and an elastic member interposed between the punch head and the retainer collar to bias the punch driver upward along the axis, wherein the punch guide comprises a peripheral slot formed on the internal periphery of the inner hollow so as to communicate with the keyway and elongated in a circumferential direction around the axis, and the retainer collar comprises a cylindrical portion fitting in the punch guide and an engaging projection portion formed on an outer periphery of the cylindrical portion and capable of passing through the keyway and engaging with the peripheral slot.

Advantageous Effects of Invention

According to the present invention, the engaging projection portion that the retainer collar has can be passed through the keyway for the key, which the punch body has, and can be engaged with the peripheral slot that the punch guide has. Therefore the construction of the punch guide is made simpler and its machining is made easier.

DESCRIPTION OF EMBODIMENTS

Certain exemplary embodiments of the present invention will be described hereinafter with reference to the appended drawings. In the following descriptions, while the term "axis" generally means a central axis of a punch body, axes of a punch guide in which the punch body fits and a punch installation hole in which the punch guide fits are common thereto. Further, while "upper" and "lower" are defined in regard to the axis, this definition is only for the convenience of explanation. Embodiments where the structure is made upside down or the axis is directed horizontally, or any such variations, may be possible.

Figure 1:
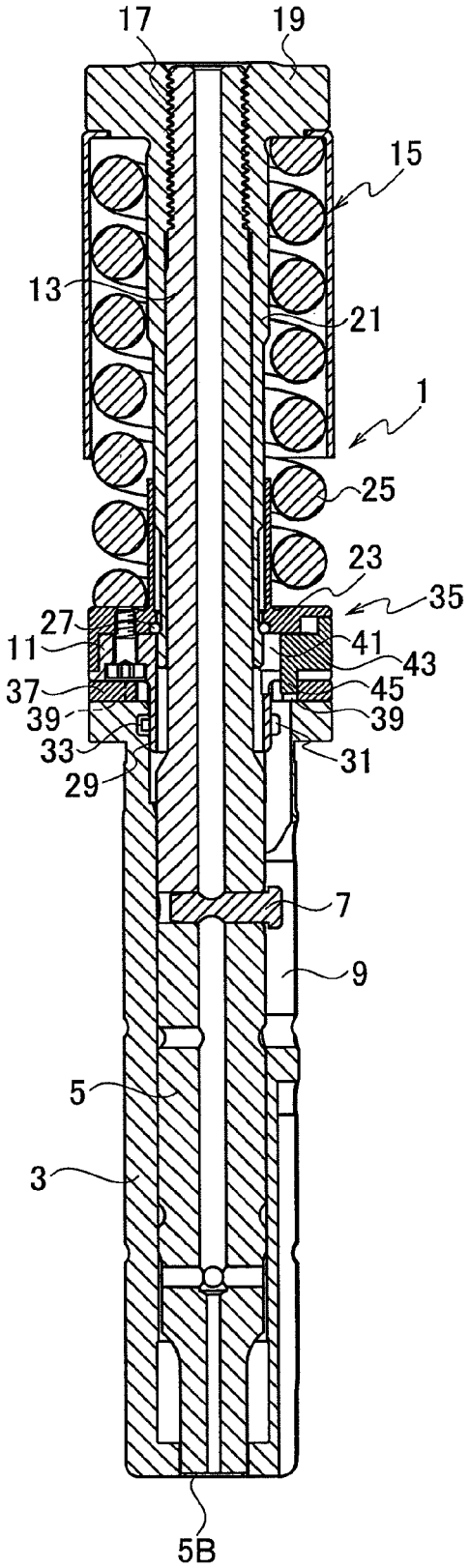
FIG. 1 is a longitudinal sectional view of a punch die according to an embodiment of the present invention.

Referring to FIG. 1, a punch die according to an embodiment of the present invention is attached to a punch holder (corresponding to an upper turret in a case of a turret punch press) of a punch press such as a turret punch press and then used. This punch die 1 is, as with a generally-available punch die, comprised of a cylindrical punch guide 3, which fits in a punch installation hole formed in the punch holder, thereby being supported to be movable upward and downward.

In the aforementioned punch guide 3 fitted is a punch body 5 comprising a punch edge portion 5B at its lower end portion, which is made movable upward and downward along the axis. This punch body 5 is, as with a generally-available punch die, comprised of a key 7 and, as corresponding therewith, the punch guide 3 is comprised of a keyway 9 elongated along the axis on its internal periphery. The key 7 fits in the keyway 9 and is movable upward and downward along the axis. Relative rotation between the punch body 5 and the punch guide 3 is thus restricted.

With the punch guide 3, at its upper end along the axis, detachably coupled is a retainer collar 11 of a ring-like shape. The punch body 5 is, unitarily at its upper portion, or as a separate body but fixed thereto, comprised of a punch driver 13. The punch driver 13 penetrates the retainer collar 11 and is movable along the axis. The punch driver 13 is comprised of a stripper unit 15 at its upper portion.

In more detail, at its upper end portion along the axis of the punch driver 13 formed is a male screw portion 17, and the stripper unit 15 is comprised of a punch head 19, which screws on the male screw portion 17. The punch head 19 is comprised of a sleeve 21 formed to be elongate downward. On an outer periphery of the sleeve 21 fitted is a spring seat 23, which is provided on the upper face of the retainer collar 11 in a unitary manner in such a way as to be movable upward and downward along the axis. Between the spring seat 23 and the punch head 19, an elastic member as a stripper spring is repulsively loaded. In the meantime, the sleeve 21 fits in the spring seat 23 and is movable relative thereto only in directions along the axis, and relative rotation between the spring seat 23 and the sleeve 21 is restricted. And, a stopper 27 such as a snap-ring engaged with a lower end portion or its vicinity of the sleeve 21 prevents the sleeve 21 from getting out.

The retainer collar 11 is, at its lower face, comprised of a downward-projecting portion 29 of a cylindrical shape, which is capable of fitting on (fitting in) the punch guide 3 from its upper side. The downward-projecting portion 29 is, at a part of its outer periphery, comprised of an engaging projection portion 33, which is engageable with a circular engaging slot (peripheral slot) 31 formed on the internal periphery of the punch guide 3. The length of the engaging projection portion 33, in its circumferential direction, is smaller than the width of the keyway 9 of the punch guide 3.

By the aforementioned construction, in a state where the engaging slot 31 engages with the engaging projection portion 33, the retainer collar 11 is barred (restricted) from getting out upward relative to the punch guide 3. And, when rotating the retainer collar 11 relative to the punch guide and placing the engaging projection portion 33 at the position of the keyway 9, the retainer collar 11 is allowed to get upward out of the punch guide 3. As being understood already, the retainer collar 11 is rotatable relative to the punch guide 3 and also capable of being fixed therewith temporarily.

Figure 2:
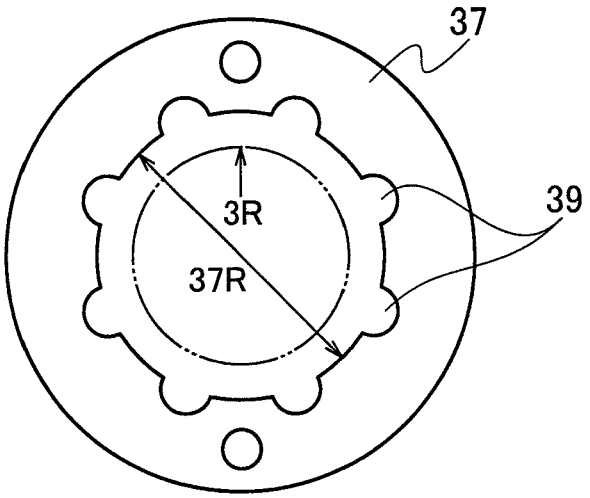
FIG. 2 is a plan view of a ring member.

In order to temporarily fix the retainer collar 11, on upper faces of the retainer collar 11 and the punch guide 3 provided is a locking mechanism 35. The locking mechanism 35 is configured to allow rotation of the retainer collar 11 relative to the punch guide 3 and also temporarily fix the rotation. In more detail, on the upper face of the punch guide 3 combined is a ring member 37 by means of a fastener (not shown) such as a pin or an attachment screw. As shown in FIG. 2, the ring member 37 has an inner hollow and its internal diameter 37R is greater than the internal diameter 3R of the punch guide 3. On an internal periphery of the inner hollow formed is a plurality of dent portions 39 getting dented radially outward at proper intervals in its circumferential direction. As having the ring member 37, a circular opening (an inner hollow of the ring member 37 having the internal diameter 37R) is opened on the upper face of the punch guide 3, which is larger in diameter than the internal diameter 3R of the punch guide 3.

The retainer collar 11 is comprised of a guiding slot 41 and a press-button 43 radially slidably engage in the guiding slot 41. The press-button 43 is comprised of an engaging portion 45 projecting downward from its lower portion in a way as to be engageable with the plurality of dent portions 39 formed on the ring member 37. The engaging portion 45 is engageable with any of the plurality of dent portions 39. Between the retainer collar 11 or the spring seat 23 and the press-button 43 repulsively loaded is an elastic member (not shown) such as a coil spring, thereby steadily biasing the press-button 43 radially outward.

The engaging portion 45 of the press-button 43 is, as being biased radially outward, set in a state of engaging with any of the dent portions 39 of the ring member 37. Therefore, in a normal state, it is set in a state where rotation of the retainer collar 11 relative to the punch guide 3 is restricted. When pressing the press-button 43 radially inward against the biasing force, the engaging portion 45 is released from the dent portion 39 of the ring member 37 inward, so that the retainer collar 11 is allowed to rotate relative to the punch guide 3.

As described above, when releasing the engaging portion 45 inward from the dent portion 39, the engaging portion 45 takes a position between the internal periphery of the ring member 37 and the internal periphery of the punch guide 3. In other words, the engaging portion 45 takes a position at the outside of the range of upward and downward motion of the sleeve 21 of the punch head 19. Therefore, supposed that the press-button 43 failed to go back to the initial position by the biasing force, the engaging portion 45 and the sleeve 21 would not interfere, thereby the punch body 5 is movable along the axis relative to the punch guide 3 with no hitch.

By the way, to attach or detach the punch body 5 to or from the punch guide 3, it is necessary to press the press-button 43 inward against the biasing force and keep the engaging portion 45 of the press-button 43 apart from the dent portion 39 of the ring member 37. Next the retainer collar 11 is rotated relative to the punch guide 3 and the engaging projection portion 33 provided on the retainer collar 11 is aligned with the keyway 9 of the punch guide 33 in the circumferential direction as shown in FIG. 3B.

When the engaging projection portion 33 is aligned with the keyway 9 in the circumferential direction as described above, the key 7 fitting with the punch body 5 is aligned with the engaging projection portion 33 in the circumferential direction. Then the engaging projection portion 33 and the key 7 can pass through the keyway 9 and move upward relative to the punch guide 3. More specifically, the punch body 5 and the retainer collar 11 can be taken upward out of the punch guide 3.

As being understood already, as the key 7 formed on the punch body 5 and the engaging portion 33 formed on the retainer collar 11 are aligned with each other in the circumferential direction, both the key 7 and the retainer collar 11 can pass through the keyway 9 of the punch guide 3, thereby the punch body 5 and the retainer collar 11 can be attached to or detached from the punch guide 3. More specifically, disassembly and assembly of the punch die 1 is easy.

When one is intended to fit the punch body 5 in the punch guide 3 and regulate its height, the whole thereof can be made upside down so as to direct the punch edge portion 5B of the punch body 5 upward. As the punch edge portion 5B is directed upward, one can readily get a view of exit or entry of the punch edge portion 5B relative to the punch body 5, thereby allowing the height regulation under the vision. Then he or she can hold the stripper unit 15 with the right hand and press the press-button by a finger of the hand. He or she next catches and rotates the punch guide 3 by the left hand.

As the press-button 43 exists in the retainer collar 11 and the retainer collar 11 is directly above the hand keeping the stripper unit 15, he or she readily press the press-button 43 with a finger of the same hand. Therefore he or she makes the punch edge portion 5B upward and gets a view thereof, thereby readily regulating the height. When the punch edge portion 5B is viewed as described above, the hand to press the press-button 43 comes to the lower side and the punch guide 3 at the upper side is rotated. The punch body 5 is therefore prevented from unintentionally getting downward out of the punch guide 3.

Figure 3A:
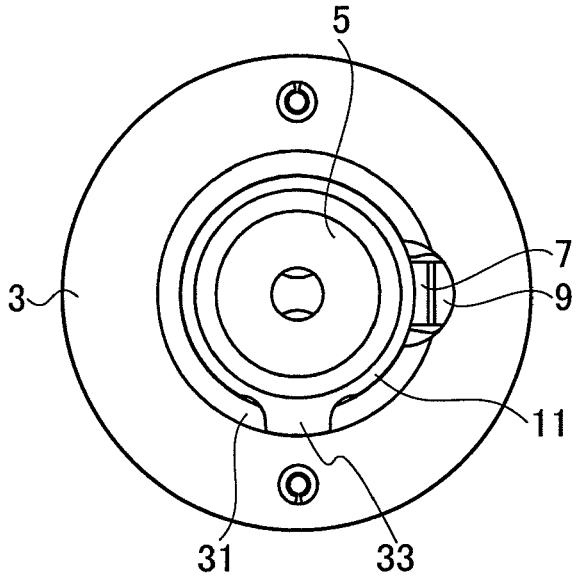
FIG. 3A is a plan view of a punch guide and a punch body, which shows a state where a key meets a keyway and an engaging projection portion is not aligned therewith.
Figure 3B:
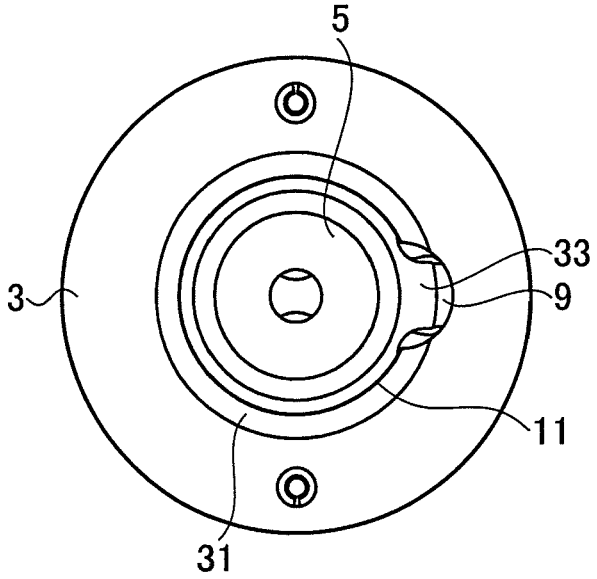
FIG. 3B is a plan view of the punch guide and the punch body, which shows a state where the engaging projection portion is aligned with the keyway.

When rotating the punch guide 3 relative to the punch body 5, as shown in FIG. 3A, as the keyway 9 is not aligned with the position of the engaging projection portion 33 in the circumferential direction, the engaging projection portion 33 gets engaged with the peripheral slot 31. Therefore even in a case where the hand holding the stripper unit 15 is unintentionally detached therefrom, the punch body 5 keeps in place in the punch guide 3 and is therefore prevented from getting out.

As being understood from the above explanation, the press-button 43 constituting the locking mechanism 35 is provided on the retainer collar 11. Therefore, it is easy and safe to regulate the height with making the lower end portion of the punch die 1 upward to get a view of exit and entry of the punch edge portion 5B of the punch body 5.

Further, in the construction as described above, the engaging projection portion 33 of the retainer collar 11, in common with the key 7 of the punch body 5, has a construction to pass through the keyway 9 of the punch guide 3 in the upward and downward directions. Therefore it is unnecessary to form a passing slot on the punch guide particularly for the engaging projection portion 33. Thus the construction of the punch guide 3 can be made simpler and machining thereof is made easier.

Further, when one is intended to attach or detach the punch body 5 and the retainer collar 11 to or from the punch guide 3, he or she aligns the key 7 of the punch body 5 with the engaging projection portion 33 of the retainer collar 11. He or she next disengages the engaging projection portion 33 of the key 7 from the keyway 9 of the punch guide 3 simultaneously. Therefore it is easy to attach or detach the punch body 5 and the retainer collar 11 to or from the punch guide 3.

In the above descriptions, the dent portions 39 are formed on the ring member 37 which the upper face of the punch guide 3 comprises. The circular opening may be directly formed on the upper face of the punch guide 3 and the dent portions 39 may be formed on the internal periphery of the circular opening.

Further, the descriptions exemplify a case where the press-button 43 of the locking mechanism 35 is radially movable. The press-button may be, however, instead movable in the axial direction or in the circumferential direction. More specifically, it is possible to engage or disengage the engaging portion 45 with or from the dent portion 39 by moving the press-button in the axial direction or in the circumferential direction.

Although the invention has been described above by reference to certain embodiments of the invention, the invention is not limited to the embodiments described above. Modifications and variations of the embodiments described above will occur to those skilled in the art, in light of the above teachings.

INDUSTRIAL APPLICABILITY

A punch die by which a punch body does not readily fall down is provided.

The invention claimed is:

1. A punch die comprising:

a punch body comprising a punch edge portion at a lower end portion along an axis, a key projecting from an outer periphery, and a punch driver at an upper portion along the axis;

a punch guide comprising an inner hollow elongated along the axis and receiving the punch body to be movable along the axis, and a keyway formed on an internal periphery of the inner hollow and elongated along the axis so as to receive and guide the key;

a retainer collar rotatably combined with the punch guide at an upper end along the axis and around the axis, the punch driver passing through the retainer collar to be movable along the axis;

a punch head screwed in an upper end portion along the axis of the punch driver to regulate a position of the punch driver; and an elastic member interposed between the punch head and the retainer collar to bias the punch driver upward along the axis, wherein the punch guide comprises a peripheral slot formed on the internal periphery of the inner hollow, the peripheral slot crossing the keyway and elongated in a circumferential direction around the axis, and the retainer collar comprises a cylindrical portion fitting in the punch guide and an engaging projection portion formed on an outer periphery of the cylindrical portion and capable of passing through the keyway in the axial direction and engaging with the peripheral slot, and wherein the retainer collar is so dimensioned as to have the engaging projection portion engaged with the peripheral slot in a state where the keyway is not aligned with the engaging projection portion in the circumferential direction, and is so dimensioned as to allow the engaging projection portion to pass through the keyway in a state where the keyway is aligned with the engaging projection portion in the circumferential direction.

2. The punch die of claim 1, wherein the key and the engaging projection portion, when being aligned in the circumferential direction, allow the punch body to be attached to and detached from the punch guide and, when being misaligned in the circumferential direction, keep the punch body within the punch guide.

3. The punch die of claim 2, further comprising:

a plurality of dent portions formed on an upper face of the punch guide at intervals in the circumferential direction; and a press-button supported by the retainer collar and comprising an engaging portion capable of engaging with any of the plurality of dent portions.

4. The punch die of claim 1, further comprising:

a plurality of dent portions formed on an upper face of the punch guide at intervals in the circumferential direction; and a press-button supported by the retainer collar and comprising an engaging portion capable of engaging with any of the plurality of dent portions.

* * * * *